US009377756B2

(12) United States Patent
Takenaga

(10) Patent No.: US 9,377,756 B2
(45) Date of Patent: Jun. 28, 2016

(54) VENTILATION STRUCTURE AND IMAGE FORMING APPARATUS WITH SAME

(71) Applicant: Noriaki Takenaga, Kanagawa (JP)

(72) Inventor: Noriaki Takenaga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 49 days.

(21) Appl. No.: 14/048,098

(22) Filed: Oct. 8, 2013

(65) Prior Publication Data

US 2014/0126926 A1 May 8, 2014

(30) Foreign Application Priority Data

Nov. 7, 2012 (JP) ..... 2012-245573

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 21/20; F24F 7/00; F24F 7/06
See application file for complete search history.

(56) References Cited

U.S. PATENT DOCUMENTS

| | | | | | |
|---|---|---|---|---|---|
| 4,867,574 | A * | 9/1989 | Jenkofsky | ..... | 374/121 |
| 5,957,582 | A * | 9/1999 | Gillen et al. | ..... | 374/130 |
| 5,999,768 | A * | 12/1999 | Gillen et al. | ..... | 399/92 |
| 6,024,487 | A * | 2/2000 | Gillen et al. | ..... | 374/121 |
| 2013/0164057 | A1 * | 6/2013 | Endo et al. | ..... | 399/329 |

FOREIGN PATENT DOCUMENTS

| | | | | | |
|---|---|---|---|---|---|
| JP | 05126646 | A * | 5/1993 | ..... | G01J 5/06 |
| JP | 2001-228742 | | 8/2001 | | |
| JP | 2009075373 | A * | 4/2009 | | |

OTHER PUBLICATIONS

Machine translation of Numata et al. (2009).*

* cited by examiner

*Primary Examiner* — David Gray
*Assistant Examiner* — Sevan A Aydin
(74) *Attorney, Agent, or Firm* — Harness, Dickey & Pierce, P.L.C.

(57) ABSTRACT

A ventilation structure includes a duct unit between a heat generating structure and a heat insulating structure. The ventilation structure includes a heat generating structure side flow channel formed on the heat generating structure side in the duct unit to take in and let fresh air flow along a long side of the duct unit and a heat insulating structure side flow channel formed on the heat insulating structure side in the duct unit to exhaust air outputted from an exhaust system provided in the heat generating structure by letting the air flow and evacuate along the short side of the duct unit.

20 Claims, 5 Drawing Sheets

VENTILATION STRUCTURE AND IMAGE FORMING APPARATUS WITH SAME

CROSS-REFERENCE TO RELATED APPLICATION

This patent application is based on and claims priority pursuant to 35 U.S.C. §119 to Japanese Patent Application No. 2012-245573, filed on Nov. 7, 2012 in the Japan Patent Office, the entire disclosure of which is hereby incorporated by reference herein.

BACKGROUND

1. Technical Field

This invention relates to an image forming apparatus, such as a copier, a printer, a facsimile machine, a multifunctional machine combining multiple functions of these devices, etc., and in particular to a ventilation structure used in the image forming apparatus.

2. Related Art

A fixing device is generally provided in an electro-photographic image forming apparatus, such as a copier, a printer, a facsimile machine, a multi-functional machine combining multiple functions of these devices, etc., to melt and fix toner (i.e., developer) onto a recording medium.

The fixing device generally includes a fixing roller as a fixing member to fix an image onto a recording medium and a pressure roller opposed to the fixing roller as an opposed member to form a fixing nip therebetween. A heater is disposed in the fixing roller. The pressure roller contacts the fixing roller with a prescribed pressure and forms the fixing nip at a pressure contact section, in which the pressure roller and the fixing roller mutually contact each other.

In recent years, image forming apparatuses capable of executing high-speed processing are in demand. However, in such a high speed machine, as line speed and/or a sheet thickness increase, the amount of heat emitted by the fixing device also increases and greatly contributes to an increase in temperature inside the apparatus, which is undesirable because the precision of a temperature detector such as a thermopile or the like disposed in the fixing device to control the temperature of the fixing roller is degraded by exposure to high temperatures, as is the performance of a belt cleaner disposed close to the fixing device.

Conventionally, a system to prevent such a rise in temperature of the temperature detector as described in JP-2001-228742-A is known.

Specifically, as described in JP-2001-228742-A, a temperature detector is attached to a frame of an apparatus body opposed to a fixing cover covering a fixing device at a prescribed distance. The system of JP-2001-228742-A is thus designed to let air flow into a space formed between the frame of the apparatus body and the fixing cover. That is, by blowing air into the space and thereby preventing a rise in temperature of the temperature detector, thereby maintaining accurate temperature detection by the temperature detector.

However, with the above-described system of JP-2001-228742-A, although air flows around the temperature detector to prevent a rise in temperature of the temperature detector, the airflow does not reach the belt cleaner and thus a rise in temperature of the belt cleaner is not prevented. Moreover, since the air simply flows, cooling is generally insufficient.

Further, because a thermopile is categorized into a non-contact type temperature detector, a surface of a temperature detection element of the thermopile needs to directly face a temperature detection object. Specifically, any object is inhibited to intervene a space between the fixing roller and the thermopile, while the thermopile needs to avoid exposure of its own.

Since the fixing roller is used in high temperature environment at about 180 degree Celsius, silicone oil included in the fixing roller volatiles as a result. In the past, however, no counter measure is taken against contamination of the surface of the detection element caused by the volatile gas emitted from the fixing roller.

When the surface of the detection element of the detector is contaminated by the volatile gas, temperature detection cannot be accurate.

SUMMARY

Accordingly, one aspect of the present invention provides a novel ventilation structure that includes a duct unit between a heat generating structure and a heat insulating structure. The ventilation structure includes a heat generating structure side flow channel formed on the heat generating structure side in the duct unit to take in and let fresh air flow along a long side of the duct unit and a heat insulating structure side flow channel formed on the heat insulating structure side in the duct unit to let exhaust outputted from an exhaust system provided in the heat generating structure flow and evacuate along a short side of the duct unit.

Another aspect of the present invention provides a novel image forming apparatus that includes a fixing device to fix an image onto a recording medium; a cleaning unit disposed close to the fixing device to execute cleaning; and a ventilation structure, with the ventilation structure including a duct unit provided between a heat generating structure and an heat insulating structure. The ventilation structure further includes a heat generating structure side flow channel formed on the heat generating structure side in the duct unit to take in and let fresh air flow along a long side of the duct unit and a heat insulating structure side flow channel formed on the heat insulating structure side in the duct unit to let exhaust outputted from an exhaust system provided in the heat generating structure flow and evacuate along the short side of the duct unit. The ventilation structure is disposed between the fixing device and the cleaning unit, and the fixing device constitutes the heat generating structure while the cleaning unit constitutes the heat insulating structure, and the image forming apparatus is composed of one of a copier, a facsimile machine, a printer, a duplicator, an ink jet printing system, and an MFP (multifunctional printer) that combines at least two of these devices.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
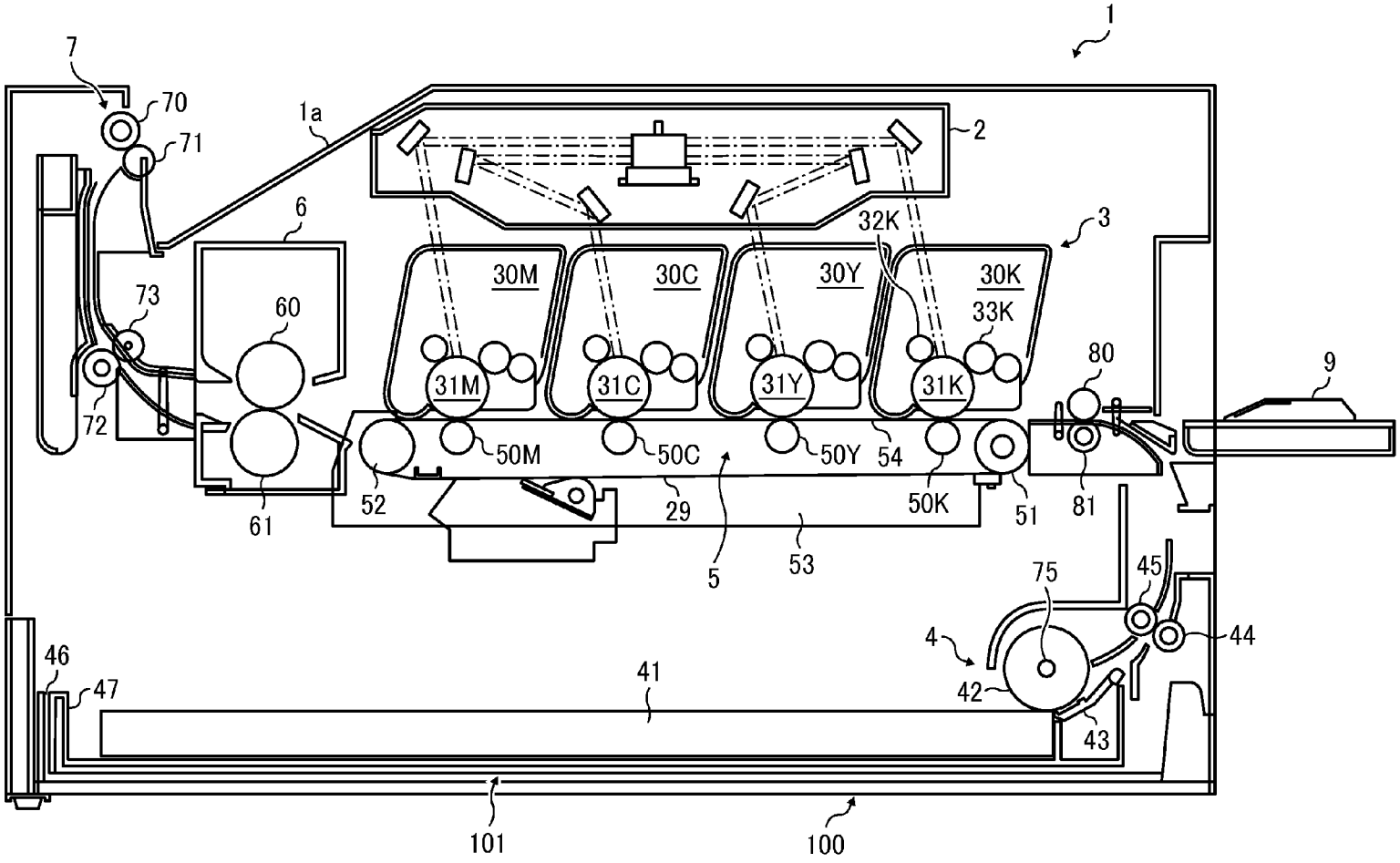
FIG. 1 is a diagram showing an overall configuration of an exemplary image forming apparatus according to one embodiment of the present invention.

Referring now to the drawings, wherein like reference numerals designate identical or corresponding parts throughout the several views thereof and in particular to FIG. 1, an image forming apparatus according to embodiments will be described. An image forming apparatus 1 includes an image forming unit (i.e., an image forming apparatus) 3 at an upper side in an apparatus body 1, and a sheet supplying unit 100 at a lower side in the apparatus body 1. The sheet-supplying unit 100 includes a medium container 47, a sheet-supplying device 4, and a sheet supplying apparatus body 101 accommodating the medium container 47 and the sheet-supplying device 4. When it is installed in the sheet supplying apparatus body 101 or the like, a holder 46 holds the medium container 47.

The sheet-feeding device 4 has a rotary shaft 75 and a sheet-feeding roller 42. Thus, when the sheet feeding roller 42 rotates around its axis, the sheet feeding roller 42 and a separation pad 43 opposed to the sheet feeding roller 42 as a separation member cooperatively dispatch (i.e., feed) a sheet of recording medium from a bundle of the recording media accommodated in the medium container 47. The recording medium fed from the medium container 47 is further transferred toward a pair of registration rollers 80 and 81 (e.g. with a registration tension roller 80) by a pair of vertical conveyor rollers 44 and 45. A tip of the recording medium collides with (runs into) a nip formed between the pair of registration rollers 81 and 80 and is thereby aligned thereat. Subsequently, the registration roller 81 is synchronized to rotate again with the arrival thereat of a toner image to align a transfer position of a recording medium with the toner image.

The image forming unit (i.e., the image forming apparatus) 3 includes a horizontally disposed transfer belt unit 5 and four image forming units (e.g. developing machines) 30M, 30C, 30Y, and 30K also horizontally disposed side by side above the transfer belt unit 5. Hereafter, one of development machines 30K is typically described. The developing machine 30K includes a photoconductor (e.g. a photoconductive drum) 31K as an image bearer. The developing machine 30K further include a charging roller 32K that charges a surface of the photoconductor 31K, a developing roller 33K to develop an electrostatic latent image formed on the photoconductor 31K into a toner image, a transfer roller 50K that transfer toner onto a recording medium, and a cleaner (not shown in the drawing) that scrapes off residual toner remaining thereon after a transferring process, etc., around (the outer circumferential side of) the photoreceptor 31K. Further, substantially the same configuration is employed in each of the other developing machines.

Above the image forming units 30M, 30C, 30Y, and 30K, an optical unit 2 is disposed as an exposure device. The optical unit 2 emits laser light toward the photoconductive drum 31.

The transfer belt unit 5 includes an endless transfer belt 29, a driving roller 52, and a driven roller 51. In the transfer belt unit 5, the transfer belt 29 is wound around and is accordingly stretched by the driving and driven rollers 52 and 51. Inside an upper run of the transfer belt 29, multiple transfer rollers 50M, 50C, 50Y, and 50K are placed at opposed positions to the respective photoconductive drums 31M, 31C, 31Y, and 31K provided in the image forming units 30M, 30C, 30Y, and 30K to contact the transfer belt 29 while each receiving a prescribed transferring bias voltage.

Upon passing the transfer belt unit 5, the images are transferred onto the recording medium. Further, the recording medium with the image transferred thereonto is further conveyed downstream to the fixing device 6, so that the fixing device 6 fuses the image. The fixing device 6 includes a fixing roller 60 as a fixing member to fix the image onto the recording medium and a pressure roller 61 opposed to the fixing roller 60 as an opposing member to form a fixing nip therebetween. A heater (not shown in the drawing) is also disposed in the fixing roller 60 as a heating device. The fixing roller 60 is pressed against the pressing roller 61 with a prescribed amount of pressure, thereby forming the fixing nip at a pressure contact section in which both fixing roller 60 and the pressing roller 61 contact each other.

The recording medium with the image fixed by the fixing device 6 exits the image forming apparatus through a sheet-ejecting unit 7 onto a sheet-ejecting unit 1*a* disposed on the top of the image forming apparatus body 1. The sheet-ejecting unit 7 includes a pair of sheet-conveying rollers 72 and 73 and a pair of sheet ejecting rollers 70 and 71. The apparatus body 1 also includes a manual sheet-feeding tray 9.

Figure 2:
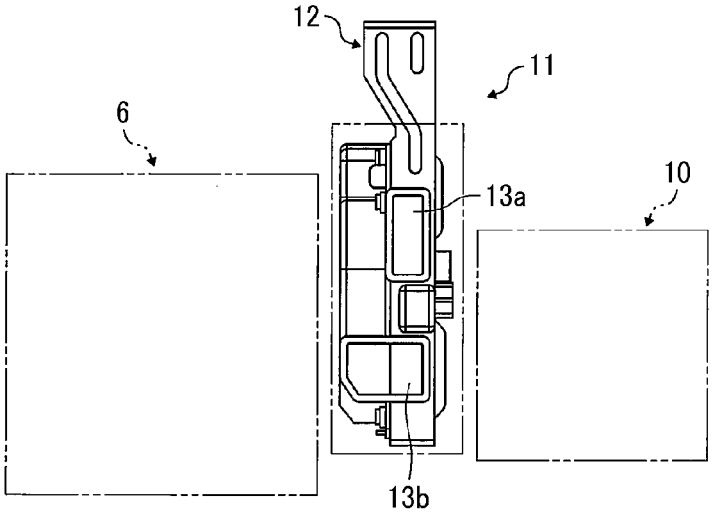
FIG. 2 is a schematic diagram illustrating relative positions of a fixing device, a cleaning unit, and a duct unit provided in the image forming apparatus according to one embodiment of the present invention.

Here, a belt cleaner (i.e., a cleaning unit) 10 (as shown in FIG. 2) is disposed near the transfer belt 29 in the image forming apparatus to clean a surface of the transfer belt 29. Between the fixing device 6 as a heat generating structure and the cleaning unit 10 as a heat insulating structure, there is disposed a duct unit 12 as a ventilation structure 11.

Figure 3:
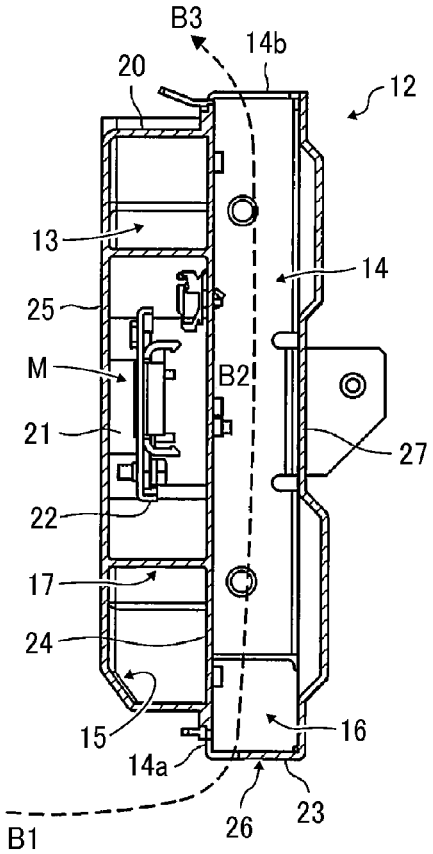
FIG. 3 is a cross-sectional view illustrating an exemplary duct unit according to one embodiment of the present invention.

As shown in FIG. 3, the above-described duct unit 12 is provided in the ventilation structure 11 and includes a heat generating structure side flow channel 13 disposed on a side of the fixing device 6 and a heat insulating structure side flow channel 14 disposed on a side of the cleaning unit 10.

The duct unit 12 includes a first chamber 15 to configure the heat generating structure side flow channel 13 and a second chamber 16 to configure the heat insulating structure side flow channel 14. Because of this, a cross section of the first chamber 15 has a flat rectangular shape and is disposed with its shorter side directed along the vertical axis. Further, a cross section of the second chamber 16 disposed beside the first chamber 15 has a flat rectangular shape again and is disposed with its shorter side directed along the vertical axis as well.

Figure 4:
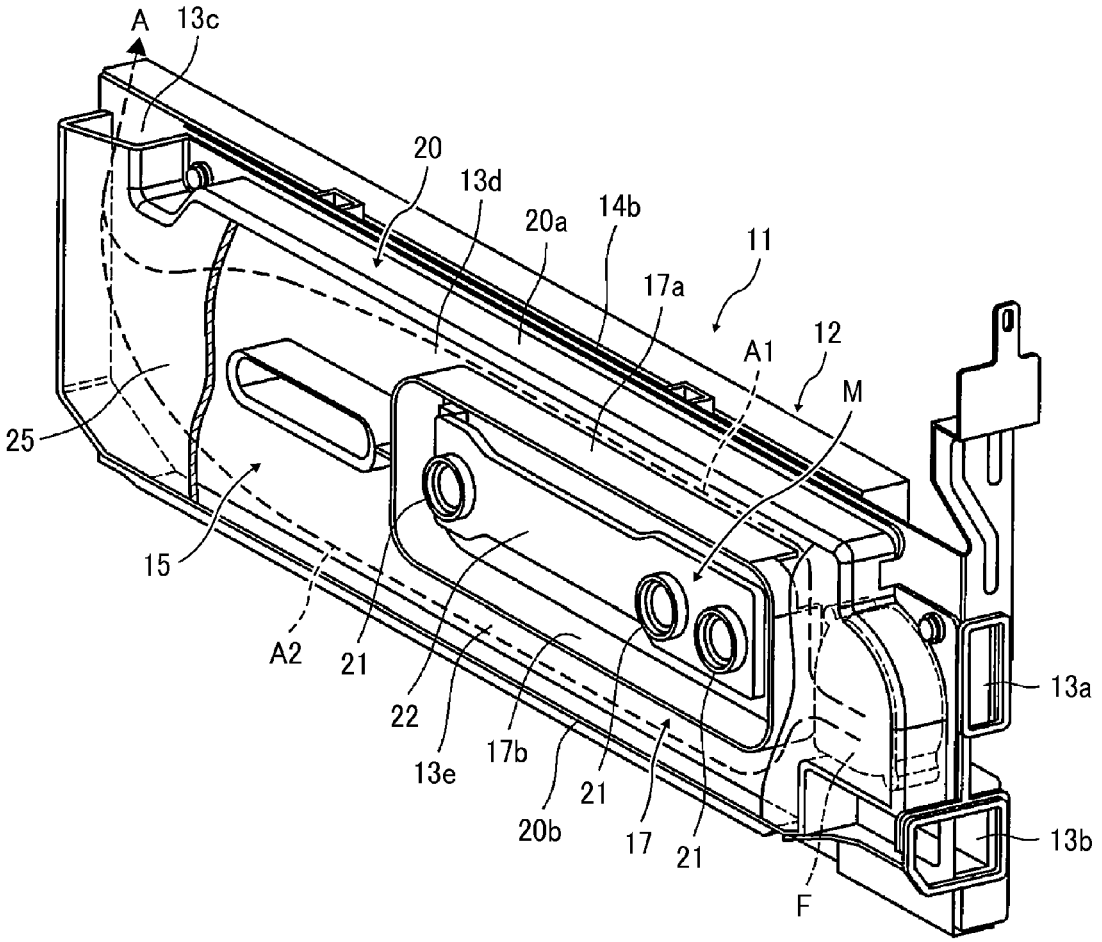
FIG. 4 is a perspective view illustrating the duct unit taken from the fixing device according to one embodiment of the present invention.

Further, as shown in FIG. 3, the first chamber 15 includes a partition wall 24 to separate the first chamber 15 from the second chamber 16, an outer circumferential wall 20, and an outer wall 25 disposed on the side of the heat generating structure. Further, as shown in FIG. 4, a pair of openings is formed at one end of the first chamber 15 along the long side of the duct unit 12 to configure multiple inlet ports 13*a* and 13*b* in the heat generating structure side flow channel 13. An opening is also formed at the other end of the first chamber 15 along the long side of the duct unit 12 to configure an air exhaust port 13*c* in the heat generating structure side flow channel 13.

Each of the inlet ports 13*a* and 13*b* is rectangular, and one of them (e.g. upper inlet port 13*a*) is disposed with its longitudinal side extended along the vertical axis, while the other one of them (e.g. lower intakes 13*b*) is disposed with its shorter side being extended along the vertical axis. Further, upper side and lower side flow channels 13*d* and 13*e* extended at upper and lower sides, respectively, are formed in the heat generating structure side flow channel 13. Specifically, a rectangular frame body 17 is formed in the first chamber 15, and the upper flow channel 13*d* is thereby formed in between an upper longer side 17*a* (of the rectangular frame body 17) and an upper wall 20*a* of the outer circumferential wall 20 of the first chamber 15. Further, a lower flow channel 13*e* is also formed between a lower longer side 17*b* (of the rectangular frame body 17) and a lower wall 20*b* of the outer circumferential wall 20 of the first chamber 15.

Further, a fan mechanism F including a sirocco fan is positioned upstream of the upper and lower flow channels 13*d* and 13*e*. Thus, by driving the fan mechanism F, fresh air is introduced to the heat generating structure side flow channel 13 from the inlet ports 13*a* and 13*b*. Further, the airflow then separates into two airflows that respectively flow through the upper flow channel 13*d* and the lower flow channel 13*e* in the heat generating structure side flow channel 13, and further flow toward the air exhaust port 13*c* located downstream (i.e., the other end of the duct unit 12 in its longitudinal direction) as shown by arrows A1 and A2, respectively, in FIG. 4.

The air exhaust port 13*c* is opened upwardly in the first chamber 15 at downstream of the upper wall 20*a* of the outer circumferential wall 20 provided therein. Hence, the fresh air flows through both the upper and lower flow channels 13*d* and 13*e* as respectively shown by arrows A1 and A2 in FIG. 4. The upper and lower flow channels 13*d* and 13*e* are merged with each other at downstream and the fresh air merged exits from the air exhaust port 13*c* as shown by arrow A. Here, a small gap is formed between a thermopile 21 and the outer wall 25, so that captured air goes out from the gap as shown by arrow.

As shown in FIG. 3, the second chamber 16 includes the partition wall 24 disposed to separate the second chamber 16 from the first chamber 15, an outer circumferential wall 26, and a side wall 27 disposed on the side of the heat insulating structure. Further, in the outer circumferential wall 26, an upward opening is almost entirely formed thereover along a long side of the duct unit 12 to configure an air exhaust port 14*b* in the heat insulating structure side flow channel 14.

Figure 5:
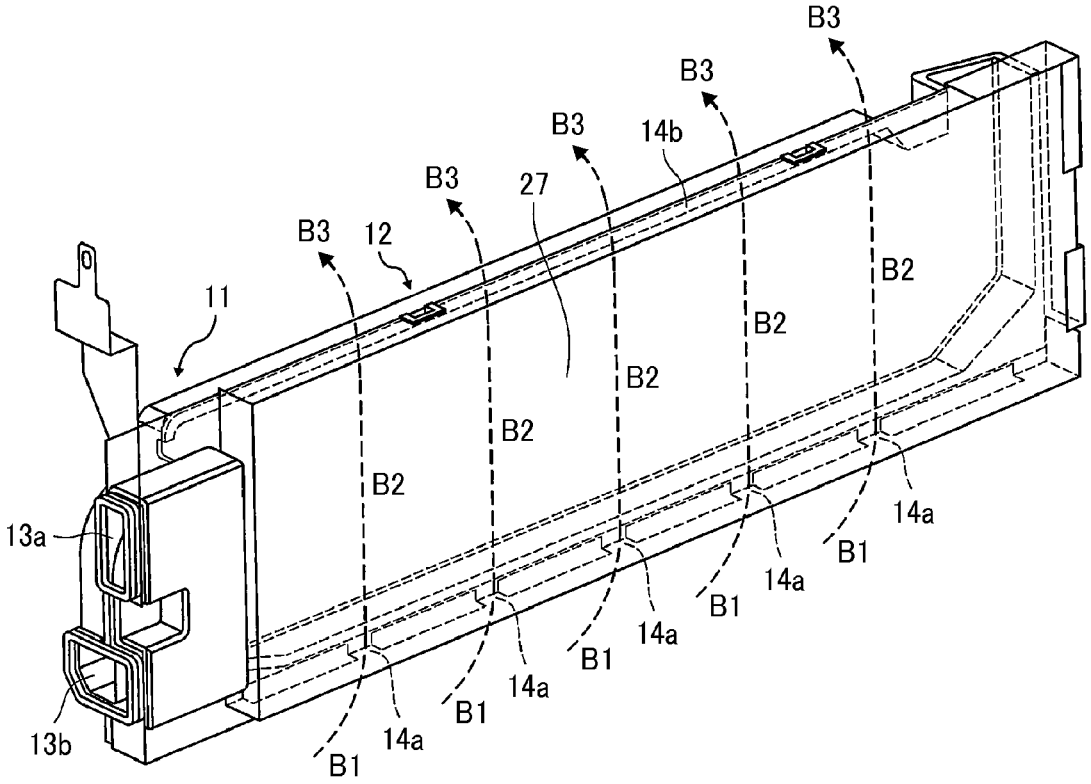
FIG. 5 is a perspective view illustrating the duct unit taken from a cleaning unit of the above described duct unit.

In such a situation, an inlet port 14*a* is positioned near the fixing roller 60 included in the fixing device 6. Specifically, as shown in FIG. 3, a prescribed number of corners meeting a bottom wall 23 of the outer circumferential wall 26 of the second chamber 16 and the partition wall 24 separating the first and second chambers 15 and 16 from each other are notched to constitute the prescribed number of inlet ports 14*a*. Here, as shown in FIG. 5, five notches are placed in the duct unit 12 along the long side thereof with a prescribed pitch.

Accordingly, these inlet ports 14*a* face an air exhausting system provided in the heat generating structure (i.e., the fixing device 6). Thus, as shown by partial arrow B1 (i.e., a first portion of arrow B1-B3) in FIG. 3, exhaust outputted from the air exhausting system the heat generating structure (i.e., the fixing device 6) enters the lower inlet port 14*a* and passes through the heat insulating structure side flow channel 14 as shown by partial arrow B2 (i.e., a second portion next to the first portion of arrow B1-B3). The exhaust subsequently evacuates from the upper air exhaust port 14*b* as shown by partial arrow B3 (i.e., a third portion next to the second portion of arrow B1-B3). Hence, since the five notches are placed in the duct unit 12 along the long side thereof with a prescribed pitch as described above, the air flowing in the direction shown by partial arrows B1 and B3 is separated into five routes.

Further, in the first chamber 15 that constitutes the heat generating system side flow channel 13, there is provided a non-contact type temperature detector M to detect temperature of the fixing roller 60 provided in the fixing device 6 serving as the heat generating structure.

As described above, the non-contact type temperature detector M is composed of the thermopile 21 in this embodiment. The thermopile 21 is an element to detect temperature of an object based on infrared radiation emitted by the object. The infrared radiation emitted from the object is absorbed by a heat conversion film included in the thermopile 21 and is converted into heat. Then, the heat is subsequently detected (and converted) by numerous micro-thermocouples formed on the heat conversion film as temperature.

Because of this, a supporter 22 composed of a substrate is placed in the rectangular frame body 17 of the first chamber 15 included in the duct unit 12 to support the multiple thermopiles 21. As shown in the drawing, two thermopiles 21 are disposed on the side of the sirocco fan, while one thermopile 21 is disposed at a middle of the first chamber 15 along the long side thereof as one example. The thermopile 21 is also arranged in the proximity of the fixing roller opposed thereto.

However, because the thermopile 21 is a non-contact type temperature detector, a surface of a temperature detection element of the thermopile 21 preferably directly faces the temperature detection object. Specifically, any no object can be allowed to come to a space between the fixing roller and the thermopile 21, and the thermopile 21 preferably avoids from its own exposure. However, in the past, no counter measure is taken against contamination of the surface of the detection element caused by volatile gas emitted from the fixing roller. Specifically, since the fixing roller is used under high temperature environment at about 180 degree Celsius, silicone oil included in the fixing roller volatiles. Thus, when the volatile gas contaminates the surface of the detection element of the detector, temperature detection may not be accurate. Such a problem is solved by the below described various embodiments. Specifically, since the thermopiles 21 are placed at positions closest to the fixing device 6, it is preferable to most effectively insulate the thermopiles 21 from the heat emitted from the fixing device 6. The thermopiles 21 is also preferably most effectively defended against a rise in temperature caused by heat emitted from the fixing unit 6 when detecting temperature of the fixing roller provided in the fixing device 6.

Further, in a temperature detection section (i.e., a section facing the thermopile 21) of the fixing roller 60, there is formed an opening in an exterior cover of the fixing device to detect temperature, so that the thermopile 21 can directly observe the fixing roller 60 therethrough. Therefore, volatile gas coming from the fixing roller 60 leaks to surroundings through the opening of the exterior cover. However, when the volatile gas leaks and adheres to a detection surface of the thermopile 21, accurate temperature detection becomes impossible. Accordingly, leakage of the volatile gas flowing from the fixing roller 60 is preferably minimized to effectively prevent contamination of the detection surface of the thermopile 21. For that purpose, prescribed air originated from a perimeter of the thermopile 21 is flown. That is, in the duct unit 12, fresh air generally having a lower temperature is taken therein from the outside thereof and is enabled to flow through an airflow route formed therein in which the thermopile 21 is placed.

Specifically, the fresh air taken in from outside the apparatus body 1 through the air inlet ports 13*a* and 13*b* provided in the duct unit 12 is sent by the sirocco fan into the duct unit 12, and is then discharged from the exhaust port 13*c* disposed at a rear side of the ducted unit 12.

Thus, according to above-described ventilation structure 11, the fresh air is captured from outside the apparatus body 1 and flows through the heat generating structure side flowing channel (i.e., the fixing device-side flowing channel) 13 provided in the duct unit 12. Accordingly, this prevents the temperature from in the heat generating structure side, i.e., the side of the fixing device 6, of the duct unit 12. At the same time, in the heat insulating structure side flow channel (i.e., the flow channel on the side of the cleaning unit) 14 provided in the duct unit 12, the exhaust flowing from the air exhausting system in the heat generating structure (i.e., the fixing device 6) can be discharge outside. This can reduce an amount of heat to be transferred from the heat generating structure (i.e., the fixing device) to the heat insulating structure (i.e., the cleaning unit 10).

Thus, the ventilation structure 11 can prevent a rise in temperature of the side of the heat generating structure (i.e., the fixing device 6) while reducing an amount of heat transferred to the side of the heat insulating structure (i.e., the cleaning unit 10) from the heat generating structure 6. In short, transfer of heat from the heat generating structure 6 to the heat insulating structure 10 can be effectively reduced by using these two airflow routes. Thus, a ventilation structure with an excellent function capable of protecting itself against the temperature rise can be obtained.

When the non-contact type temperature detector M is disposed along the heat generating structure side flow channel 13, a rise in temperature in the non-contact type temperature detector M can be more highly likely prevented and temperature detection can be further stabilized for a longtime.

Further, when the non-contact type temperature detector M is configured by the thermopile 21, characteristics of the thermopile 21 (i.e., high output response speed, high sensitivity, small temperature dependence, and high productivity or the like) can be effectively obtained.

When the duct unit 12 includes the supporter 22 supporting the thermopile 21, the thermopile 21 can constantly prevent temperature increase due to airflow generated within the duct unit 12.

When the heat generating system side flow channel 13 includes the inlet ports 13*a* and 13*b* at one end along the long side of the duct unit 1 and an air exhaust port 13*c* at the other end along the long side of the duct unit 1, because fresh air flows over the entire length of the duct unit 12, a rise in temperature of the duct unit 12 can be effectively prevented.

Further, when the heat insulating structure side flow channel 14 includes the inlet ports 14*a* at the bottom of the duct unit 12 along the short side of the duct unit and the air exhaust port 14*b* at the upper section in the duct unit 1 in the same direction, exhaust flow can be a short-circuit while preventing transfer of heat from the heat generating structure to the heat insulating structure.

For this reason, when the above-described ventilation structure 11 shown in FIG. 1 is used in the image forming apparatus, the thermopile 21 can live longer while constantly detecting the temperature of the fixing roller 60 during the long life. Further, the belt-cleaning unit 10 can also effectively prevent its own deterioration possibly caused by a rise in temperature. Because of this, the image forming apparatus employing such a ventilation structure 11 can generate a high quality image for a longtime.

Further, as already described earlier, when the volatile gas comes from the fixing roller 60 and leaks to surroundings thereof through the opening of the exterior cover, and subsequently adheres to the detection surface of the thermopile 21, accurate temperature detection becomes impossible. Accordingly, leakage of the volatile gas is preferably minimized.

Figure 6:
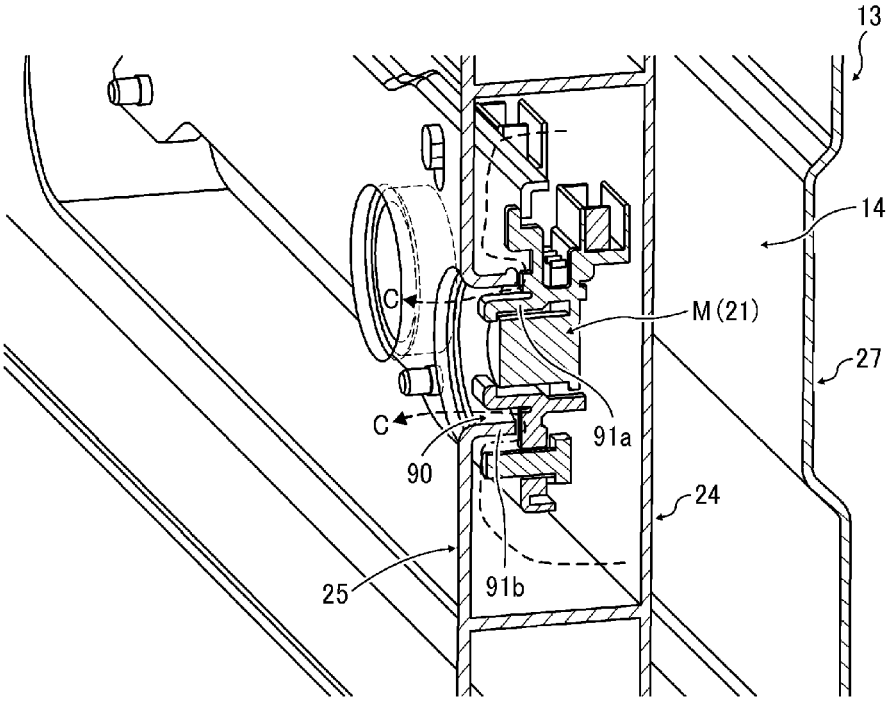
FIG. 6 is a perspective sectional view illustrating the duct unit in which a thermopile element is built in as a non-contact type temperature detector.

Accordingly, as shown in FIG. 6, an air exhaust port 90, generally disposed around the thermopile 21 that serves as the non-contact type temperature detector M to be used by a temperature detector, is more favorably disposed in the external wall 25. For this purpose, the air exhaust port 90 is appropriately shaped to match a shape of the detection lens of the thermopile 21, and is formed in a circular state. Specifically, by disposing an inner circumferential wall 91*a* and the outer circumferential wall 91*b* outside the inner circumferential wall 91*a* on the periphery of the thermopile 21, the air exhaust port 90 having a ring-shaped gap with a prescribed interval is formed therebetween.

By forming the air exhaust port 90 having such a gap in this way, an airflow route to allow air to flow in a direction as shown by arrow C in FIG. 6 is formed. Accordingly, air (i.e., air blow) flowing through the duct unit 1 partially issues from the gap, i.e., the air exhaust port 90 as a result.

Figure 7:
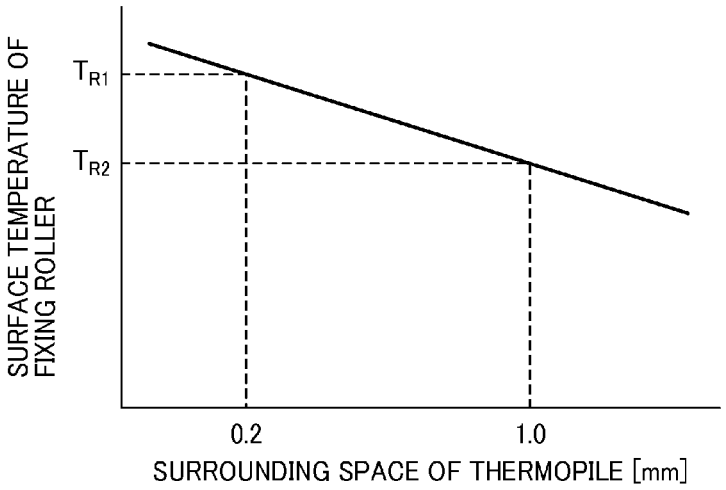
FIG. 7 is a chart illustrating a relation between a space near the thermopile and temperature of a surface of the fixing roller.

Further, an amount of airflow to drain from the air exhaust port 90 is controlled by this gap. Specifically, as shown in a chart of FIG. 7 that indicates a relation between ambient temperature of surroundings of the thermopile M (21) and (detected) surface temperature of the fixing roller, when a gap in the vicinity of the thermopile M becomes larger, the temperature of the fixing roller decreases. However, the temperature of the fuser roller is different depending on usage environment and operation mode. Specifically, when the maximum permissible levels of the surface temperature of the fixing roller in a typical mode are supposed to be TR1 and TR2, a gap value (i.e., a distance between the inner circumferential wall 91*a* and the outer circumferential wall 91*b*) within the allowable range of the surface temperature of the fixing roller ranges from about 0.2 mm to about 1.0 mm. In other words, by rendering the gap to be from about 0.2 mm to about 1.0 mm, the surface temperature of the fixing roller can be the maximum permissible temperatures TR1 and TR2 in the typical operation mode.

Hence, by disposing the air exhaust port 90 in the surrounding part of the thermopile 21 serving as the non-contact type temperature detector M and utilizing the air flowing from the thermopile 21, contamination possibly caused by the volatile gas flowing from the fixing roller 60 can be more effectively suppressed.

According to the present invention, the above-described image formation device employed in the various embodiments can include an electronic photographic copier, a laser printer, and a facsimile machine or the like.

Further, the number of inlet ports of the heat generating system side flow channel 13 is not limited to two and may include only one and three or more. The number of air exhaust ports of the heat generating structure side flow channel 13 is not limited to only one and may include two or more as well. Although the heat generating system side flow channel 13 includes two flowing channels of the upper flow channel 13*d* and the lower flow channel 13*e* in the above-described applicable embodiment, the flow channel 13 is enough even if it is not separated by the first chamber or may be separated into three or more routes.

Although the number of routes of the heat insulating structure side flow channel 14 is five in the above-described applicable embodiment, the number of routes of the exhaust system provided in the heat generating structure to output exhaust therefrom can be increased or decreased while either increasing or decreasing the number of notches constituting the inlet ports 14*a*.

Further, according to another embodiment of the present invention, the recording medium includes a 90K-sheet, such as a plain paper sheet (generally used for copying), an OHP (overhead projector) sheet, a card, a postcard, etc., and a cardboard having a basis weight (grammage) of approx. 100 g/m$^2$ or more, etc., and a so-called special sheet having heat capacity greater than the postcard, etc.

Hence, according to one aspect of the present invention, a ventilation structure can likely prevent a rise in temperature in a heat generating structure while reducing an amount of heat transferred from the heat generating structure toward the heat insulating structure. Specifically, heat transfer from the heat generating structure toward the heat insulating structure can be effectively suppressed by using a pair of airflow routes. Accordingly, a ventilation structure having excellent performance of minimizing a rise in temperature can be obtained.

According to another aspect of the present invention, with some of the air flowing along a long side of the duct, contamination caused by volatile gas entering a thermopile from the fixing device (i.e., a fixing roller) can be likely prevented. That is, a ventilation structure includes a duct unit between a heat generating structure and a heat insulating structure. The ventilation structure includes a heat generating structure side flow channel formed on the heat generating structure side in the duct unit to take in and let fresh air flow along a long side of the duct unit and a heat insulating structure side flow channel formed on the heat insulating structure side in the duct unit to let exhaust outputted from an exhaust system provided in the heat generating structure flow and evacuate along the short side of the duct unit.

According to yet another aspect of the present invention, a ventilation structure can more likely prevent a rise in temperature in a heat generating structure while reducing an amount of heat transferred from the heat generating structure toward the heat insulating structure. Because, a non-contact type temperature detector is provided along the heat generating system side flow channel to detect temperature of the heat generating structure.

According to yet another aspect of the present invention, a ventilation structure can more likely prevent a rise in temperature in a heat generating structure while reducing an amount of heat transferred from the heat generating structure toward the heat insulating structure. Because, the non-contact type temperature detector includes a thermopile.

According to yet another aspect of the present invention, a ventilation structure can more likely prevent a rise in temperature in a heat generating structure while reducing an amount of heat transferred from the heat generating structure toward the heat insulating structure. Because, an air exhaust port is disposed in an area surrounding the thermopile serving as the non-contact type temperature detector.

According to yet another aspect of the present invention, a ventilation structure can more likely prevent a rise in temperature in a heat generating structure while reducing an amount of heat transferred from the heat generating structure toward the heat insulating structure. Because, a shape of the air exhaust port is circular to match a detecting lens included in the thermopile serving as the non-contact type temperature detector.

According to yet another aspect of the present invention, a ventilation structure can more likely prevent a rise in temperature in a heat generating structure while reducing an amount of heat transferred from the heat generating structure toward the heat insulating structure. Because, a gap as the air exhaust port disposed between a member surrounding the thermopile serving as the non-contact type temperature detector and the thermopile is from about 0.2 mm to about 1.0 mm.

According to yet another aspect of the present invention, a ventilation structure can more likely prevent a rise in temperature in a heat generating structure while reducing an amount of heat transferred from the heat generating structure toward the heat insulating structure. Because, a supporter is provided in the duct unit to support the thermopile.

According to yet another aspect of the present invention, a ventilation structure can more likely prevent a rise in temperature in a heat generating structure while reducing an amount of heat transferred from the heat generating structure toward the heat insulating structure. Because, a fan mechanism is provided in the heat generating structure side flow channel of the duct unit to introduce fresh air.

According to yet another aspect of the present invention, a ventilation structure can more likely prevent a rise in temperature in a heat generating structure while reducing an amount of heat transferred from the heat generating structure toward the heat insulating structure. Because, the heat generating system side flow channel includes: an inlet port provided at one end in a long side of the duct unit; a first air exhaust port provided at the other end along the long side of the duct unit; and a second air exhaust port provided around the non-contact type temperature detector to be used by the temperature detector.

According to yet another aspect of the present invention, a ventilation structure can more likely prevent a rise in temperature in a heat generating structure while reducing an amount of heat transferred from the heat generating structure toward the heat insulating structure. Because, the heat insulating structure side flow channel includes: an inlet port disposed in a bottom side of the duct unit along the short side of the duct unit; and an air exhaust port disposed at an upper side in the duct unit along the short side of the duct unit.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various aspects and can be appropriately changed.

What is claimed is:

1. A ventilation structure comprising:

a duct unit provided between a heat generating structure and a heat insulating structure, the duct unit including a first chamber, a second chamber, and a partition wall separating the first chamber and the second chamber, the first chamber including a first inlet port and a first air exhaust port, the second chamber including a second inlet port and a second air exhaust port;

a heat generating structure side flow channel including the first chamber and formed on a heat generating structure side in the duct unit to take in fresh air from the first inlet port of the first chamber and let the fresh air flow to the first air exhaust port of the first chamber along a long side of the duct unit; and a heat insulating structure side flow channel including the second chamber and formed on a heat insulating structure side in the duct unit to exhaust air outputted from the heat generating structure by letting the air flow from the second inlet port of the second chamber to the second air exhaust port of the second chamber along a short side of the duct unit.

2. The ventilation structure as claimed in claim 1, further comprising a non-contact type temperature detector provided along the heat generating side flow channel to detect temperature of the heat generating structure.

3. The ventilation structure as claimed in claim 2, wherein the non-contact type temperature detector includes a thermopile.

4. The ventilation structure as claimed in claim 3, further comprising a third air exhaust port disposed in an area surrounding the thermopile serving as the non-contact type temperature detector.

5. The ventilation structure as claimed in claim 4, wherein a shape of the third air exhaust port is circular to match a detecting lens included in the thermopile serving as the non-contact type temperature detector.

6. The ventilation structure as claimed in claim 4, wherein the third air exhaust port disposed between a member surrounding the thermopile serving as the non-contact type temperature detector and the thermopile has a gap of from 0.2 mm to 1.0 mm.

7. The ventilation structure as claimed in claim 3, further comprising a supporter provided in the duct unit to support the thermopile.

8. The ventilation structure as claimed in claim 1, further comprising a fan mechanism in the heat generating structure side flow channel of the duct unit to introduce the fresh air into the ventilation structure.

9. The ventilation structure as claimed in claim 2, wherein the the first inlet port is provided at a first end along the long side of the duct unit;

the first air exhaust port is provided at another end in the long side of the duct unit; and a third air exhaust port is provided around the non-contact type temperature detector to be used by the temperature detector.

10. The ventilation structure as claimed in claim 1, wherein the the second inlet port is disposed in a bottom side of the duct unit along the short side of the duct unit; and the second air exhaust port is disposed at an upper side in the duct unit along the short side of the duct unit.

11. An image forming apparatus, comprising:

a fixing device to fix an image onto a recording medium;

a cleaning unit disposed close to the fixing device to execute cleaning; and a ventilation structure including a duct unit provided between a heat generating structure and a heat insulating structure, the duct unit including a first chamber, a second chamber, and a partition wall separating the first chamber and the second chamber, the first chamber including a first inlet port and a first air exhaust port, the second chamber including a second inlet port and a second air exhaust port;

a heat generating structure side flow channel including the first chamber and formed on a heat generating structure side in the duct unit to take in fresh air from the first inlet port of the first chamber and let the fresh air flow to the first air exhaust port of the first chamber along a long side of the duct unit; and a heat insulating structure side flow channel including the second chamber and formed on a heat insulating structure side in the duct unit to exhaust air outputted from the heat generating structure by letting the air flow from the second inlet port of the second chamber to the second air exhaust port of the second chamber along a short side of the duct unit, wherein the ventilation structure is disposed between the fixing device and the cleaning unit, and the fixing device constitutes the heat generating structure while the cleaning unit constitutes the heat insulating structure, wherein the image forming apparatus is composed of one of a copier, a facsimile machine, a printer, a duplicator, an ink jet printing system, and a multifunctional printer that combines at least two of these devices.

12. The image forming apparatus as claimed in claim 11, further comprising a non-contact type temperature detector provided along the heat generating side flow channel to detect temperature of the heat generating structure.

13. The image forming apparatus as claimed in claim 12, wherein the non-contact type temperature detector includes a thermopile.

14. The image forming apparatus as claimed in claim 13, wherein a third air exhaust port is disposed in an area surrounding the thermopile serving as the non-contact type temperature detector.

15. The image forming apparatus as claimed in claim 14, wherein a shape of the third air exhaust port is circular to match a detecting lens included in the thermopile serving as the non-contact type temperature detector.

16. The image forming apparatus as claimed in claim 14, wherein a gap of the third air exhaust port formed between a member surrounding the thermopile serving as the non-contact type temperature detector and the thermopile is from 0.2 mm to 1.0 mm.

17. The image forming apparatus as claimed in claim 13, further comprising a supporter provided in the duct unit to support the thermopile.

18. The image forming apparatus as claimed in claim 12, wherein the first inlet port is provided at one end along the long side of the duct unit;

the first air exhaust port is provided at the other end along the long side of the duct unit; and a third air exhaust port is provided around the non-contact type temperature detector to be used by the temperature detector.

19. The image forming apparatus as claimed in claim 11, further comprising a fan mechanism in the heat generating structure side flow channel of the duct unit to introduce the fresh air.

20. The image forming apparatus as claimed in claim 11, wherein the second inlet port is disposed in a bottom side of the duct unit along the short side of the duct unit; and the second air exhaust port is disposed at an upper side in the duct unit along the short side of the duct unit.

* * * * *